US006139016A

United States Patent [19]

Plato

[11] Patent Number: 6,139,016

[45] Date of Patent: Oct. 31, 2000

[54] SCENARIO GAME APPARATUS AND METHOD

[75] Inventor: Gayle J. Plato, Yardley, Pa.

[73] Assignee: By Plato, Inc., Yardley, Pa.

[21] Appl. No.: 09/212,950

[22] Filed: Dec. 15, 1998

[51] Int. Cl.[7] ..... A63F 3/00

[52] U.S. Cl. ..... 273/242; 273/292; 273/296; 273/430

[58] Field of Search ..... 273/429, 430, 273/431, FOR 429, FOR 430, FOR 431, 292, 296, 302, 236, 242, 246

[56] References Cited

U.S. PATENT DOCUMENTS

| | | |
|---|---|---|
| 3,654,712 | 4/1972 | Bagdasar . |
| 4,090,717 | 5/1978 | Rossetti . |
| 4,150,828 | 4/1979 | Marchese . |
| 4,235,442 | 11/1980 | Nelson . |
| 4,635,939 | 1/1987 | Makow . |
| 4,666,161 | 5/1987 | Elesie . |
| 4,667,959 | 5/1987 | Pfeiffer et al. . |
| 4,893,819 | 1/1990 | Wright . |
| 4,971,561 | 11/1990 | Krane . |
| 5,112,064 | 5/1992 | Weedman . |
| 5,186,467 | 2/1993 | Chasin . |
| 5,213,509 | 5/1993 | Gun . |
| 5,246,373 | 9/1993 | Becker . |
| 5,261,671 | 11/1993 | Wyatt . |
| 5,316,482 | 5/1994 | Bryson . |
| 5,657,992 | 8/1997 | Bellizzi . |
| 5,738,354 | 4/1998 | Easley . |
| 5,775,700 | 7/1998 | Hornia et al. . |
| 5,895,050 | 4/1999 | Dodd . |

FOREIGN PATENT DOCUMENTS

| | | |
|---|---|---|
| 2680979 | 3/1993 | France . |
| 2258411 | 10/1993 | United Kingdom . |

OTHER PUBLICATIONS

Publicatio of Playthings May 5, 1985, p 76–79.

*Primary Examiner*—Sebastiano Passaniti
*Assistant Examiner*—Vishu Mendiratta
*Attorney, Agent, or Firm*—John P. Blasko; Douglas J. Ryder; J. P. Blasko P.C.

[57] ABSTRACT

A game method and apparatus is disclosed. In the game, players use a game board, sets of response cards, board place markers, and a plurality of scenario cards containing brief situation descriptions and potential responses. Taking turns, players read a selected scenario card to another player. The latter player then decides which one of four possible responses best represents what he or she would truly do if faced with the described situation, and secretly indicates the choice with a response card. At the same time, all other players in the game predict how the player will respond by similarly choosing an appropriate response card. After players have all privately made their choices, they then reveal their responses. Accordingly, all players have an opportunity to then move their place markers around the board, depending on the responses given. Specifically, for a player responding to a scenario card, moves forward a number of spaces equal to the total number of players who correctly predict his or her response. Further, players who correctly predict the action of the player responding to a scenario also move their place markers a consistently specified number of spaces forward on the board. Thus, all players actively participate and have an opportunity to move forward on every turn of the game. Turns rotate among the players such that everyone has an opportunity to read and to respond to scenario cards. A player wins the game by being first to land his or her place marker on the center space.

29 Claims, 4 Drawing Sheets

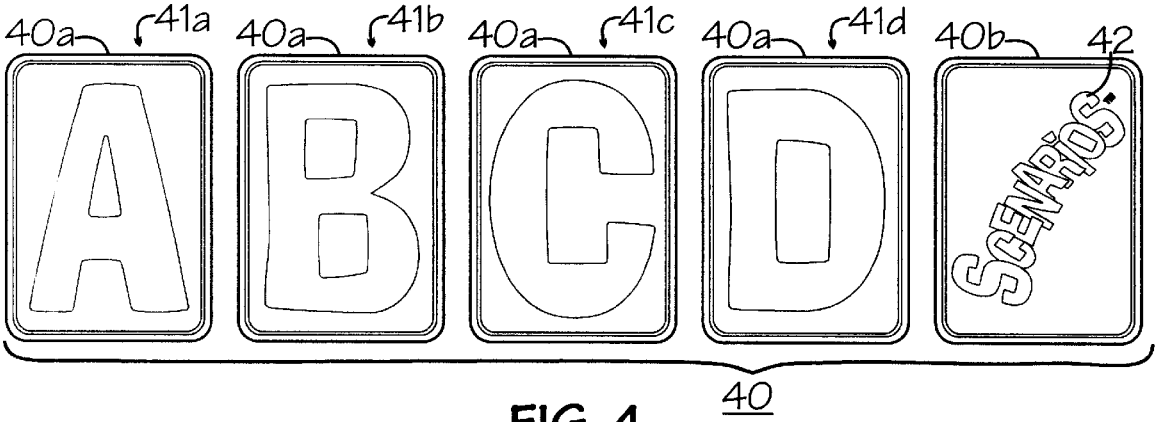

FIG. 4

50

| If today is the ... (51a) | the first turn of the game goes to the player who ... (51b) |
|---|---|
| 1st | had the **worst day** today |
| 2nd | is the **oldest** |
| 3rd | has the **largest feet** |
| 4th | did the **strangest thing** today |
| 5th | has the **longest hair** |
| 6th | ate the **most for breakfast** today |
| 7th | has the **best singing voice** |
| 8th | is wearing the **wildest clothes** |
| 9th | can tell the **funniest joke** |
| 10th | is the **tallest** |
| 11th | **slept the least** last night |
| 12th | has the **most balanced life** |
| 13th | is the **most superstitious** |
| 14th | did the **most exercise** this week |
| 15th | has the **longest fingernails** |
| 16th | is the **youngest** |
| 17th | has the **closest birthday** to today |
| 18th | is the **biggest computer nerd** |
| 19th | has the **worst singing voice** |
| 20th | read the **most books** last year |
| 21st | has the **best laugh** |
| 22nd | is the **next-to-shortest player** |
| 23rd | most recently **put out the trash** |
| 24th | is the **most athletic** |
| 25th | had the **best thing happen** today |
| 26th | is wearing the **fewest colors** |
| 27th | has the **first birthday** of the year |
| 28th | **likes cats** the most |
| 29th | did the **most work** today |
| 30th | has the **shortest or least hair** |
| 31st | **gives the best reason** to go first |

FIG. 5

SCENARIO GAME APPARATUS AND METHOD

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates to apparatus and methods for playing games, and more particularly to games encouraging players to understand and to reveal how they react in different life situations, to employ predictive abilities regarding the actions of other players, and to exercise good verbal and creative story-telling skills.

BACKGROUND OF THE INVENTION

Many games are known in which players must utilize their knowledge of each other for tactical purposes in anticipating the reactions of other players. However, such games are usually played for amusement only, and have limited value for revealing qualitative information about the players' lives, personal habits, and preferences.

Psychological assessment games are also known in which players untrained in the disciplines of psychology make personality assessments of themselves and other players based on preferences expressed as part of the game play. Thus in these games, players are labeled with certain personality descriptions as a result of playing a game in which, presumably, none of the players are professionally qualified to make such assessments.

Games are also known in which players compare responses to situational questions for the purpose of determining emotional relationship compatibility. U.S. Pat. No. 5,775,700 to Hornia et al. (1998) discloses a partnering game apparatus and method of play in which male and female players determine whether a player of their liking also likes them in some manner. However, such partnering games are normally restricted to male and female players who have either a prior relationship or a potential interest in pursuing a future partnering relationship, and may not be appropriate for a broader group of friends. Further, the types of questions posed in partnering games often solicit responses that may be considered highly personal or emotionally sensitive by some players.

Similarly, with regard to questions of a personal nature, games are known in which players are asked to reveal how they would respond in a variety of situations charged with ethical issues. In U.S. Pat. No. 4,635,939 to Makow (1987), a question and answer game apparatus and method is disclosed in which players must reveal their responses to moral dilemmas, and they are also required to make character assessments of the other players. While this form of game play may be enjoyable to some people, others may find the subject matter to be too sensitive or intrusive.

An imbalance of player participation is also a factor in many known games. U.S. Pat. No. 5,657,992 to Bellizzi (1997) discloses a game device and method for a group of people to entertain themselves by producing a story. However, one player is designated the "director" of a story development, and thus has a significantly different and more controlling role in the game than the other players. Similarly, many board games focus on a single player at a time—when it is their "turn" to make a move. Thus, while one player takes a turn in such games, the other players are often left idle while they wait for their turn to come.

Role-playing games are known in which players assume identities of characters other than themselves. Thus, participants act out behaviors of fictitious characters, but may fail to reveal anything significant about themselves. Similarly, games are known such as that disclosed by Bellizzi '992 in which participants collaborate to create a fictional story. Again, such games may be amusing, but do little to reveal personal information about the players' own lives, habits and preferences.

Games are also known that allow or even encourage players to be untruthful or to bluff. In one form of a game disclosed by Makow '939, players may secretly choose to not respond honestly, and other players may then challenge that player's credibility. While such ploys may add an element of amusement to a game, they also allow players to practice being insincere, to conceal information about themselves, and to even benefit from a successful deception.

Although board games are generally designed to serve as social entertainment and to be uplifting, games are known that incorporate negative reinforcement based on a player's action. As just one example, Makow's '939 assigns a penalty to a player for failing to respond within a specified time. Thus, while playing a game to be entertained, participants in such games may also find themselves facing social reproof when penalties are assigned.

Mental skill and scholastic knowledge lead to success in many known question and answer games. Although very popular, factually-based games such as Trivial Pursuit® which require correct responses to a wide variety of questions can also be personally intimidating to some participants. For example, rather than feeling good at the end of a game, a player who fails to correctly answer many or all of the game's questions may become embarrassed or feel educationally inadequate. Additionally, one measure of the continued success of a game is its ability to be played numerous times, with each new game play presenting unique challenges and information. However, games with a finite number of factual questions and answers can soon become uninteresting when the players become familiar with the correct response to each of the questions posed.

Many games are known in which selecting a player to take the first turn is determined by a random method such as the roll of dice. While this is certainly an efficient and fair way to decide, it does little to entertain the players or reveal any interesting information about them.

Games are also known in which an apparatus is needed to secretly record answers of players. Krane '561 describes an "answer wheel" which serves the purpose of indicating whether a player's response to a given question is "yes, no, A, B, C, or D." Inner and outer discs rotate about a rivet axis to expose the selected answer of a player. While this device serves its intended purpose, it requires some manner of assembly in manufacturing. Further, due to its size, the answer exposed by the window in the wheel may be difficult to read at a distance, and the wheel may potentially slip and alter the intended answer as the apparatus is handled.

SUMMARY OF THE INVENTION

The present invention provides an apparatus and method for playing a board game with an object of entertaining participants while providing insights into one's own actions and those of the other players. Players further discover how well they know the other game participants as they predict how each will respond to a variety of situations described in the games' scenario cards. Additionally, by reading scenarios aloud and improvising as appropriate, an object of the game is to help develop presentation and creative storytelling skills.

A preferred embodiment of the scenario game apparatus may comprise a game board including a plurality of colored spaces bearing indicia representing a plurality of situational themes. The spaces form a path or course. The game board further comprising a plurality of board markers, sets of scenario cards contained within a divided card box, sets of scenario response cards, and instructions for playing the game. The scenario cards are a plurality of cards of a first type being of like size and shape, each having a front and a reverse side, the reverse sides each being of a like appearance, and the front sides each bearing unique response indicia for corresponding to one of a predetermined set of response indicators. The scenario response cards are a plurality of cards of a second type being of like size and shape, each having a front and a reverse side, the front sides each bearing a legend describing a unique situation, and the reverse sides bearing a legend presenting unique responses to said situation corresponding to each of the response indicators of said predetermined set.

According to a preferred method of play, all players are provided with: a set of response cards each card corresponding to one of a predetermined set of response indicators; and a board place marker. A player is selected to be a first responding player of a game. All of the place markers are placed at the starting space of a game board. The first responding player chooses a scenario card and then reads the scenario information and possible scenario responses on the scenario card to all the players. The first responding player then privately decides on one of the responses set out on the scenario card and the rest of the players secretly indicate the response of the first responding players by placing response cards having the response indicator corresponding to the players selected response front-side down such that only its reverse side is exposed, rendering it indistinguishable from all other response cards. All the players then reveal their responses by turning all of the response cards front-side up such that response card selection is exposed. Finally, the players move the place markers in accordance with matching responses revealed. Specifically, the player responding to the scenario moves one space forward for each of the other players' responses that matches his or her own response. Additionally, each of the other players who correctly predicts the responding player's choice moves three spaces forward. Further, any player whose place marker is on a space with indicia matching the indicia of the player's place marker may double the allowed number of spaces to move forward. Players continue to take turns reading and responding to scenario cards in this manner, whereby each player in turn assumes the role described for the first responding player. The game is over when one or more board place markers reach the ending board space and is thus declared the winner of the game.

An advantage of the present invention is that it provides an entertaining method and apparatus which when played as described may enhance relationships of the players through increasing their knowledge about each. A further advantage is that it presents a wide variety of scenarios which may help players learn more about themselves by contemplating their own preferred reactions. Additionally, players learn more about how they are perceived by others through observing and considering the predicted responses that other players make about their reactions. Thus, players may gain new insights into specific behavioral aspects of their personalities without, as in some prior art, attaching a psychological label to their personality type.

In addition to enhancing knowledge of others and one's own self, an advantage of the present invention is that it may be played in a familiar social setting where players might feel comfortable practicing their presentation and storytelling skills. In the preferred embodiment, players may choose to read scenario cards aloud, precisely as written, or they may spontaneously embellish or personalize the stories, thereby adding to the amusement of the other players and exercising their own creative talents.

In the preferred embodiment, players are instructed to respond to all scenarios in a truthful manner. Thus, an object of the game is to promote honest and open communication among participants. Personal integrity is assumed, and players are not encouraged to challenge the character or truthfulness of a responding player, as is the practice in some forms of prior art where bluffing is encouraged. Similarly, yet another advantage of the present invention is that the scenarios do not focus on sensitive or personal matters. Scenarios concern everyday events and some whimsical fantasies, and are intended to be light-hearted and amusing and not to be a cause of emotional discomfort.

Positive reinforcement is another advantage of the current invention. Players are rewarded for correctly predicting actions of others and they are rewarded when others correctly predict what they will do. Thus, being an "open" type of person whom others know well is regarded positively. Further, in the preferred embodiment there are no overt penalties or negative actions for any type of player error.

A further object of the present invention is to promote a balanced game-playing experience in which all players participate fully and equally throughout the game. There are no "special" or "leadership" roles assigned to individual players. Every player has an equal opportunity to read and to respond to scenarios. Further, as will be appreciated, every player actively participates in every turn of the game.

Similarly, an advantage of the present game over prior art is that players do not face intellectually challenging questions which might result in feelings of inadequacy if they continually fail to reply correctly. Players always give a "right" answer when it is their turn to respond to a scenario because, by definition, the correct response to any scenario is the answer of the responding player. Thus, while some players may do better than others at predicting other players' responses or at having their own responses correctly predicted, success is based more on insight and knowledge of a person rather than on superior memory, intellect, or academic achievement.

A further advantage of the present game is the amusing manner in which the first player of the game is selected. Whereas in prior art a preferred method is often to use a random selection apparatus such as the roll of dice, the preferred embodiment of the current board game discloses a chart which contains thirty-one numbers and corresponding selection criteria. To determine the first player, participants are instructed to refer to the present day of the month on the chart, then apply the selection criterion specified. Subjective choices such as "the person who had the worst day today" or "the person who has the best laugh" are designed to amuse people and get them talking and learning about one another even before the game play begins.

The apparatus and method used for secretly recording responses to scenarios represents an advantage over prior art by way of its simplicity. Rather than requiring an electronic or mechanical device to record a discrete choice of "A", "B", "C", or "D", the present invention discloses simple sets of four response cards with individual letters inscribed on one side of each. The cards are relatively inexpensive to manufacture and simple to manipulate. Further, using sufficiently large and bold print, characters are readily recognized by players seated around a game board, even when lighting is dim.

Another advantage of the present invention relates to apparatus and method proposed for storing and organizing scenario cards. Whereas prior art is known that discloses a "card box" for holding game cards, the scenario game apparatus and method discloses a card box having at least two distinct advantages. One advantage is an inner card box base divider which conveniently separates the cards into six compartments of approximately equal size, arranged in a "two-by-three" configuration, making card selection from an appropriate stack easy. Yet another advantage is the labeling of the card box top which, when placed under the base of the card box during game play, clearly illustrates the specific type of scenario cards contained in each of the six compartments.

The apparatus of the present board game additionally incorporates a feature that facilitates its use by people who have difficulty with color recognition. By consistently associating specific symbols with colors applied in game board spaces, place markers, and scenario cards, players can readily distinguish sets that relate to one another. Thus, for example, a player who cannot distinguish a red-colored space from a green one is not at a disadvantage because each color space also has a specific symbol associated with it. This advantage further enhances the playability of the game for all participants when played under dim lighting where colors are not as readily distinguishable.

These and yet additional objects and features of the scenario game apparatus and method will become apparent in the detailed description of the invention below.

BRIEF DESCRIPTION OF THE DRAWINGS

The advantages and features of the disclosed invention are best understood by reference to the following detailed description when read in conjunction with the drawings, wherein:

FIG. 4 shows a plan view of a set of response cards illustrating four unique front sides and a common reverse side;

FIG. 5 illustrates a "First Player Selection Chart" used for determining a first player in a game;

DETAILED DESCRIPTION OF THE INVENTION

Reference will now be made in detail to the present invention, specific terminology will be used for the sake of clarity. However, the invention is not intended to be limited to the specific terms so selected.

Apparatus

Figure 1:
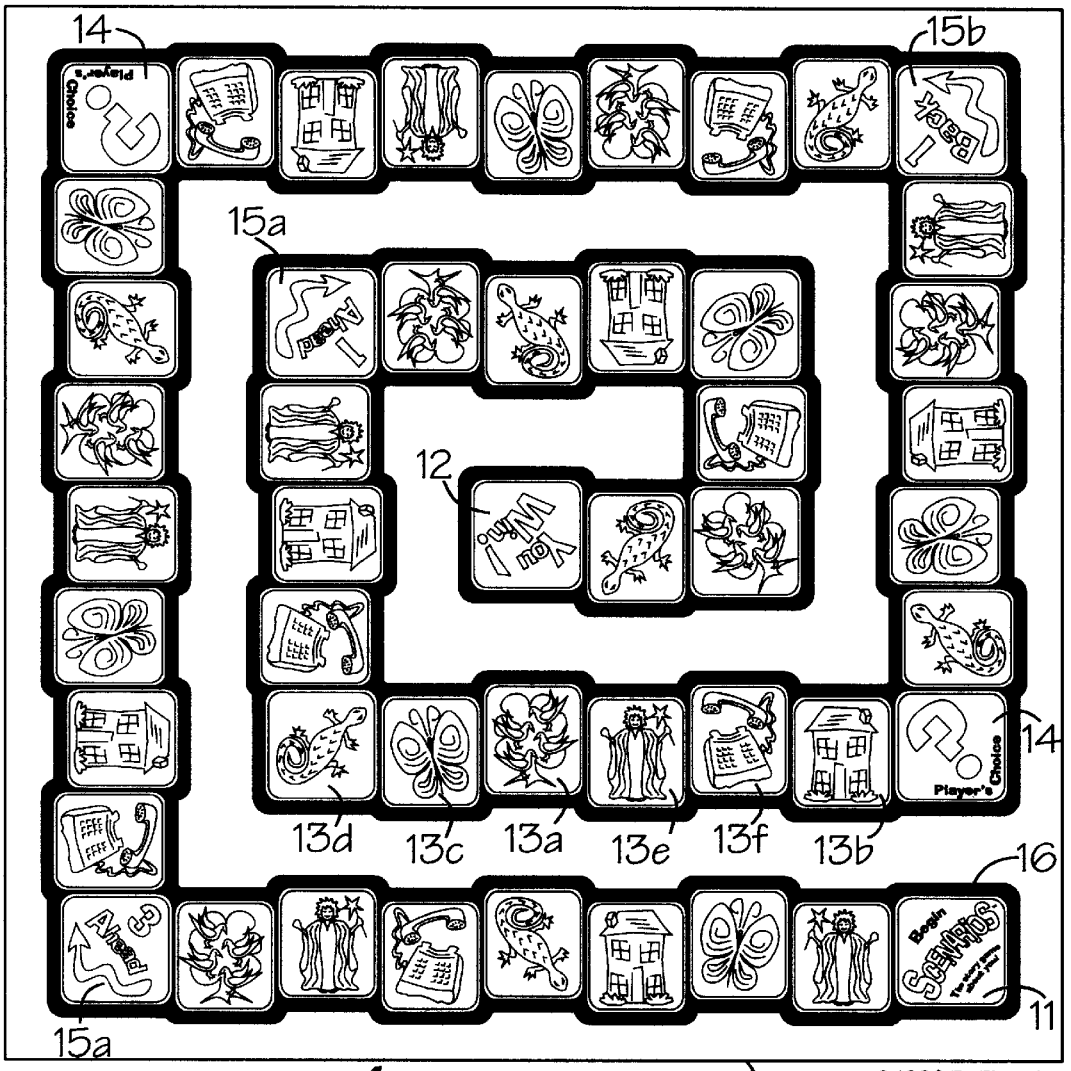
FIG. 1 is a plan view of a board for playing a game in accordance with this invention.

A preferred apparatus can be illustrated by FIG. 1 and is designated generally by reference numeral 10. As embodied herein and referring to FIG. 1, a game board 10 includes a playing surface 10*a*. Imprinted on a game board playing surface 10*a* are a starting board space 11, an ending board space 12, and a plurality of game board spaces of a type indicated by numerals 13*a*, 13*b*, 13*c*, 13*d*, 13*e*, 13*f*, 14, 15*a*, and 15*b*. More specifically, sample board spaces illustrated are defined as: "Among Friends" board space 13*a*; "Around Home" board space 13*b*; "Favorite Things" board space 13*c*; "Getting By" board space 13*d*, "Strange Stuff" board space 13*e*; and "Work Wacky" board space 13*f*. Additionally, a plurality of "Player's Choice" board spaces 14, "Move Ahead" board spaces 15*a*, and "Move Back" board spaces 15*b* are also shown. Board spaces are evenly dispersed in an angular spiral formation along a black-colored track 16, as shown.

Figure 2A:
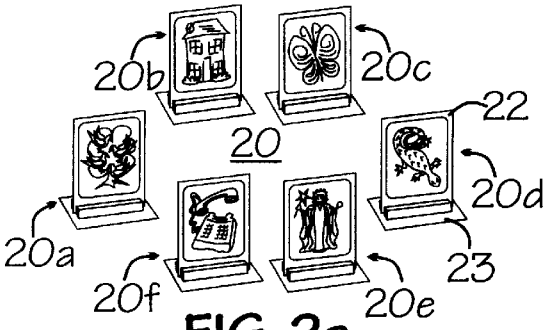
FIG. 2*a* shows a perspective view of assembled place markers used to indicate player movement around the spaces of a game board.
Figure 2B:
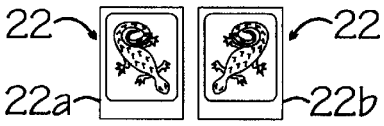
FIG. 2*b* is a plan view of an inset for an assembled place marker illustrating front and reverse side views.
Figure 2C:
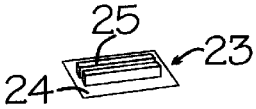
FIG. 2*c* shows a perspective view of a place marker stand for an assembled place marker.

A preferred apparatus also includes six game board place markers 20, collectively illustrated in perspective view in FIG. 2*a*. Individual place markers each bear a unique indicia, and are defined as: "Among Friends" place marker 20*a*; "Around Home" place marker 20*b*; "Favorite Things" place marker 20*c*; "Getting By" place marker 20*d*; "Strange Stuff" place marker 20*e*; and "Work Wacky" place marker 20*f*. Each place marker 20 comprises a place marker inset 22, an example of which is shown in plan view in FIG. 2*b*, and a place marker stand 23, an example of which is shown in FIG. 2*c*. Further, each inset 22 has a front side 22*a* and a reverse side 22*b*, with both sides bearing the same indicia. A place marker stand 23 provides a flat base surface 24 for stability. Place marker stand 23 also provides a gripping apparatus 25, intended to hold a place marker inset 22 firmly in place when in an assembled configuration 20.

Figure 3A:
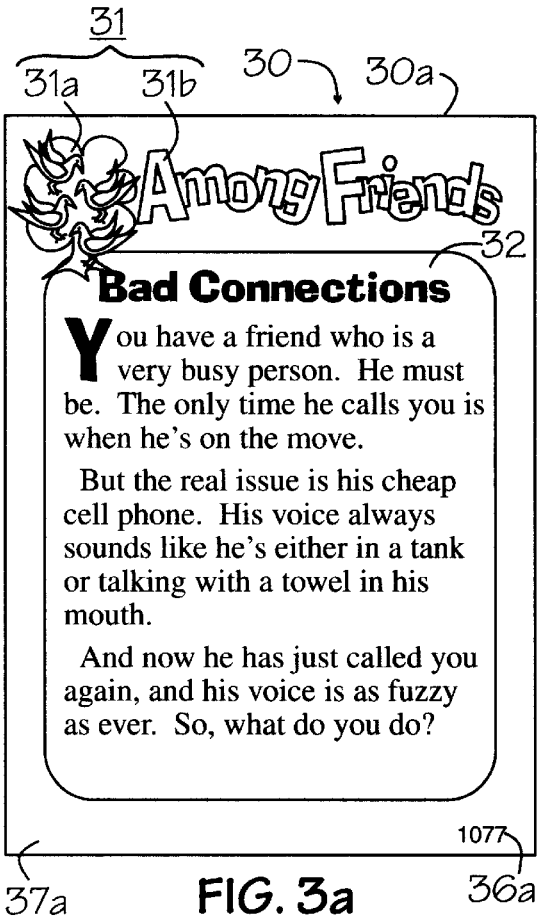
FIGS. 3*a* and 3*b* are detailed plan views of a front and reverse sides of a sample scenario card.
Figure 3B:
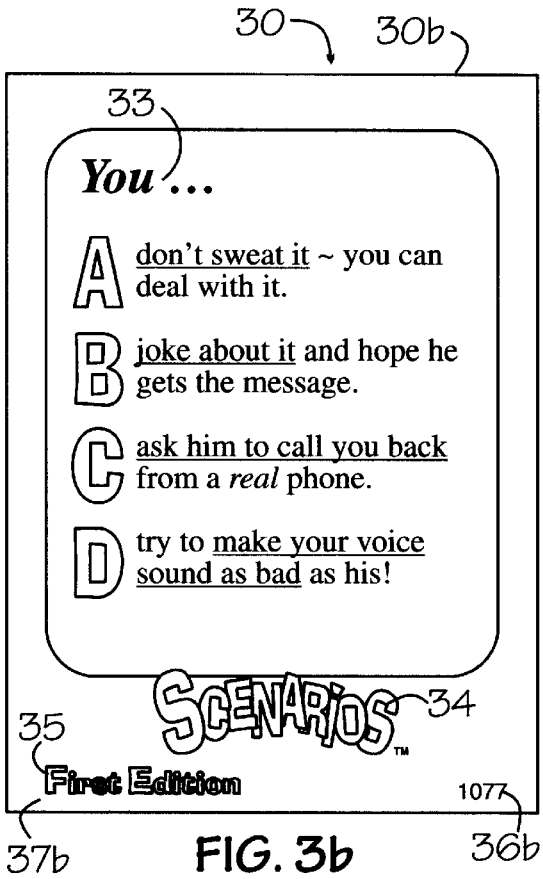

Additionally, the invention includes a plurality of scenario cards 30. FIGS. 3*a* and 3*b* provide detailed plan views of a front side 30*a* and a reverse side 30*b*, respectively, of a preferred embodiment of a scenario card 30. Specifically, a scenario card front side 30*a* comprises: a scenario card set heading 31; a titled, textual scenario 32; a unique scenario numeric identifier 36*a*; and a scenario card border 37*a* in a color associated with the specific scenario card set. A scenario card set heading 31 comprises a scenario card set indicia 31*a* and its associated scenario card set title 31*b*, and it serves to identify the theme of a scenario card 30. A scenario card reverse side 30*b* then comprises: four potential scenario responses 33; a proposed game trademark 34; a proposed game edition title 35; a unique scenario numeric identifier 36*b*—identical to identifier 36*a*; and a scenario card border 37*b*—identical in color to border 37*a*.

Figure 3C:
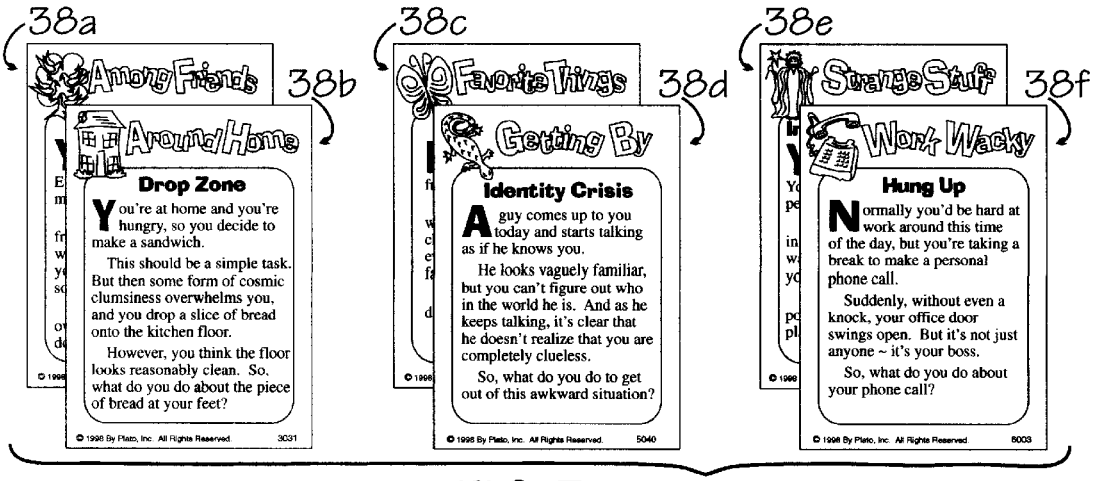
FIG. 3*c* is a plan view of six sample scenario cards illustrating headings for each type of scenario card set.

Further, FIG. 3*c* is a plan view of six sample scenario cards 30, intended to illustrate each card's unique heading 31. Shown are: "Among Friends" scenario card 38*a*; "Around Home" scenario card 38*b*; "Favorite Things" scenario card 38*c*; "Getting By" scenario card 38*d*; "Strange Stuff" scenario card 38*e*; and "Work Wacky" scenario card 38*f*.

As shown in FIG. 4, the apparatus also includes a plurality of sets of cards called collectively for convenience herein "response cards" 40. Each response card 40 has a front side 40*a* bearing a bold letter A, B, C, or D against a white background. Four different response cards 40 compose each set. In a preferred embodiment, 41*a* represents a choice "A" response card, 41*b* represents a choice "B" response card, 41*c* represents a choice "C" response card, and 41*d* represents a choice "D" response card. Each response card 40 also has a reverse side 40*b* bearing a consistent design such as a proposed game trademark 42. Thus, since all response cards 40 bear identical markings on their reverse side 40*b*, each is indistinguishable from the others when viewed from the reverse.

To provide an entertaining method of choosing one person to be the first player in a game, the preferred embodiment includes a "First Player Selection Chart" 50, an example of which is depicted in plan view in FIG. 5. Said chart 50 is a simple guideline that comprises a left date column 51*a* which lists days of the month from the "1$^{st}$" to the "31$^{st}$", and a right criterion column 51*b* which states conditions to consider when awarding the first play of a game. In a preferred embodiment of the present game, a "First Person Selection" chart 50 might be included as a part of the game's written instructions for play (not shown).

Figure 6A:
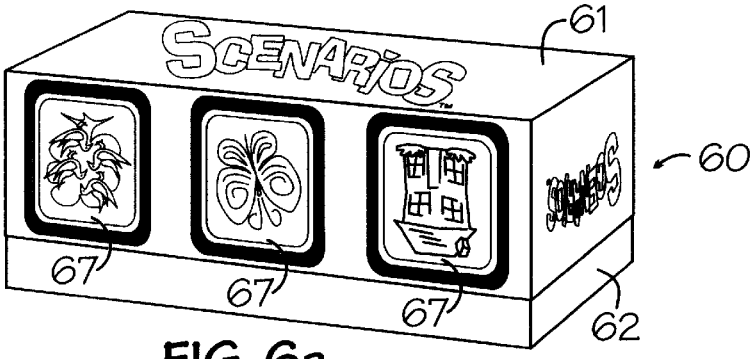
FIG. 6*a* shows a perspective view of a scenario card box illustrated in a closed configuration.
Figure 6B:
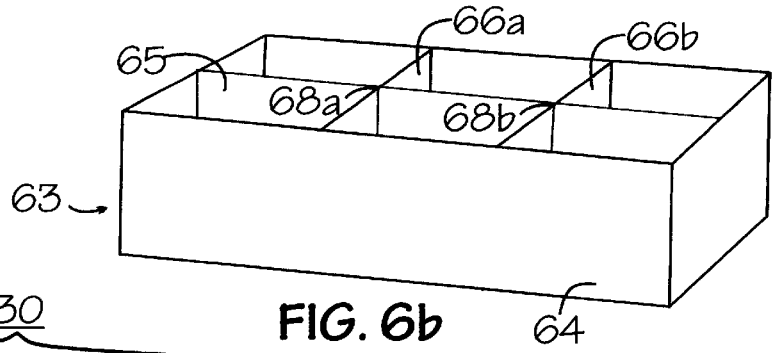
FIG. 6*b* shows a perspective view of a scenario card box base divider.
Figure 6C:
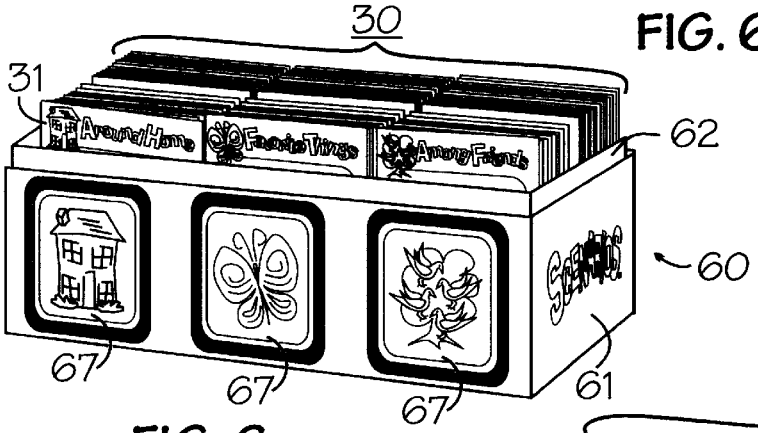
FIGS. 6*c* and 6*d* are perspective views of a scenario card box in an open configuration, illustrating front and reverse sides, respectively.
Figure 6D:
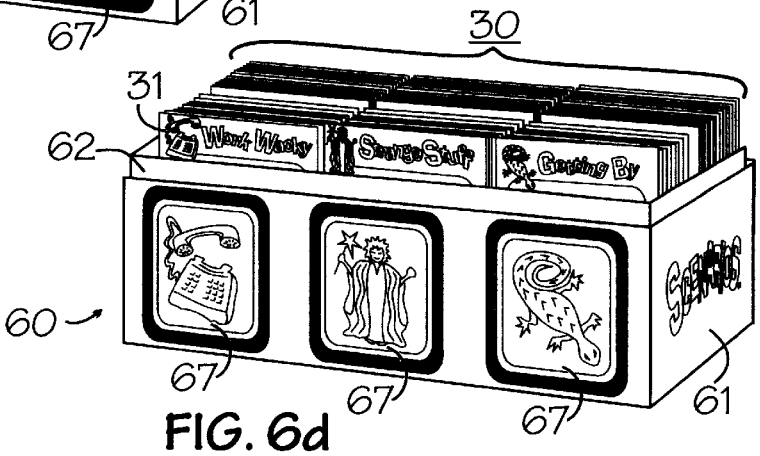

FIGS. 6*a*, 6*c*, and 6*d* illustrate different perspective views of an embodiment of scenario card box 60 in closed and open configurations. FIG. 6*b* provides a perspective view of a scenario card box divider. Thus, as shown, a scenario card box 60 comprises: a scenario card box cover 61; a scenario card box base 62; and a scenario card box base divider 63. Affixed to said box cover 61 are illustrations of each of six scenario card set indicia. More specifically, three unique indicia 67 are aligned along each of the two lengthwise surfaces of a box cover 61, as shown, such that all six scenario card set indicia are represented. As will be appreciated, when a box cover 61 is in a closed configuration as shown in FIG. 6*a*, said indicia appear upside-down. However, when a cover 61 is removed and seated underneath a card box base 62 in an open configuration, as shown in front and reverse side views in FIGS. 6*c* and 6*e*, respectively, card set indicia 67 appear in an upright position. Thus, indicia 67 serve to clearly label the location of each of six sets of scenario cards 30 in an open configuration. Further, when properly contained within an open card box 60, scenario cards 30 expose their card set headings 31 such that they are readily matched to indicia 67.

In order to keep scenario cards 30 properly separated in their individual sets, a scenario card box divider 63 is placed within a scenario card box base 62. The divider 63 comprises: a shell 64; a lengthwise section 65 that divides shell 64 approximately in half along its longer dimension; and two crosswise sections 66*a* and 66*b* that divide shell 64 into three segments of approximately equal size across its shorter dimension. Said sections 65, 66*a*, and 66*b* meet and are joined along intersection points 68*a* and 68*b* such that they form six distinct, separate compartments for holding scenario cards 30.

As will be appreciated, a central feature of the preferred scenario game apparatus is the consistent use of specific indicia and their associated colors to represent six scenario card set themes of the game. Wherever indicia appear on apparatus surfaces, they are represented in a consistent pattern and combination of colors. Further, background coloring of spaces appearing on game board 10, place markers 20, scenario cards 30, and scenario card box cover 61 consistently display specified colors associated with each form of indicia. Thus, for the sake of greater clarity throughout the present specification and drawings, an example of game indicia and their associated colors and themes are briefly described. However, such description is presented for illustration purposes only, and is not meant in any way to limit the disclosed game to the specified form of indicia or to the associated color schemes. Further, scenario card set titles 31*b* and associated themes of scenario cards 30 are presented for illustration only, and are similarly not intended to limit either the scope or variety of potential themes for the current game.

"Among Friends" indicia, symbolized by birds on a tree, are illustrated in shades of blue. Situations presented in "Among Friends" scenario cards 38*a* relate to social interactions and issues a player might encounter when in the association of friends.

"Around Home" indicia, symbolized by a two-story house, are illustrated in shades of purple. Situations described in "Around Home" scenario cards 38*b* relate to domestic matters a player might face in or around the home.

"Favorite Things" indicia, symbolized by a butterfly, are illustrated in shades of orange. Situations in "Favorite Things" scenario cards 38*c* relate to player's preferences for many different items such as food, recreation, material items, daily habits, and the like.

"Getting By" indicia, symbolized by a lizard-like character, are illustrated in shades of brown. Situations presented in "Getting By" scenario cards 38*d* involve a wide range of challenges that people regularly cope with in their daily lives, such as when driving around town, shopping, attending meetings, traveling, and such.

"Strange Stuff" indicia, symbolized by a fairy godmother type of character holding a magic wand, are illustrated in shades of red. Fanciful situations described in "Strange Stuff" scenario cards 38*e* involve fantastic and bizarre events such as winning huge amounts of money, being granted extrasensory powers, traveling through space and time, and encountering extraterrestrial beings.

"Work Wacky" indicia, symbolized by a telephone with its receiver off the hook, are illustrated in shades of green. Situations encountered in "Work Wacky" scenario cards 38*f* relate to typical and to not-so-typical issues that arise in work situations in a variety of different professions.

Method

An object of the game is for players to have an entertaining experience while gaining new insights into their fellow players and themselves. To accomplish this, players follow a method of play described below.

To begin a game, two to six players sit around a game board 10. Each player selects a place marker 20 and situates it on starting space 11. Additionally, each player takes a four-card set of response cards 40. Scenario card box 60 is opened, and box cover 61 is placed under card box base 62, as shown in two views in FIGS. 6*c* and 6*d*. When properly arranged, scenario card set headings 31 are exposed directly above their associated card set indicia 67.

One person is then chosen to be the first responding player of the game. In a preferred embodiment, players refer to a first player selection chart 50 to make this decision. As illustrated in FIG. 5, players are instructed to refer to the present day of the month on chart 50 along a left date column 51*a*, then read directly across to guidelines in a right criterion column 51*b*, and apply the selection criterion specified. Thus, for example, if the current date is the 23$^{rd}$ day of the month, players would then designate the player who most recently put out the trash to be the first responding player of the game. Subjective choices such as "the person who had the worst day today" or "the person who has the best laugh" are designed to amuse people and get them talking and learning about one another even before the game play begins.

The first responding player, then in turn the other players, take turns reading and responding to scenario cards 30 in a clockwise rotation according to their seating around game board 10. For convenience hereafter, on any turn of a game, a player whose turn it is will be referred to as a responding player. Thus, excluding an exception which is noted below, a responding player selects from scenario card box 60 a scenario card 30 that matches the color/indicia of the board space under his or her place marker 20. So, for example, a responding player whose marker 20 is placed on a "Strange Stuff" board space 13*e* would select a "Strange Stuff" scenario card 38*e*. The only exception to this rule occurs when a responding player's marker 20 is placed atop the starting space 11 or a player's choice space 14. In such instances, said player chooses any type of scenario card 30 he or she desires.

As a matter of convention, players choose scenario cards 30 in the order in which they are stacked facing forward in card box 60. Further, when they are done with a card 30, it is returned to the rear of the stack from which it was selected.

Once a responding player selects a card 30 from the appropriate stack, he or she gives it to the player on his or her right side. Again for convenience, a player receiving a card 30 from a responding player will hereafter be referred to as a reading player. A reading player then reads aloud a scenario 32 and four potential scenario responses 33 contained on both sides of a scenario card 30 that he or she was handed. The reading player may choose to either read precisely what is written—or may embellish or customize the text to make it more amusing or tailored to the responding player.

After reading a scenario card 30, a responding player decides what he would do if faced with the situation that was just read. Four potential actions are defined in scenario response 33, indicated by the letters "A", "B", "C", and "D". They are the only possible choices that a responding player may consider. Thus, a responding player then selects one choice as the action that is closest to what he or she believes truly reflects what he or she would do. Then, after deciding, a responding player secretly selects a response card 40 that matches the letter corresponding the choice and places it front side down so that only reverse side 40*b* is exposed. At the same time all other players, including the reading player, privately decide which action of response 33 is most likely the one that the responding player will select. Similarly, they also secretly choose a response card 40 that matches the letter corresponding to their prediction, and place said card 40 front side down such that only reverse side 40 *b* is exposed.

When all players have placed one of their response cards 40 down, everyone turns their own card 40 over to reveal the front side 40*a*.

After all players reveal front side 40*a* of their response cards, a determination is made as to how many spaces each player moves his or her place marker 20 forward on game board 10. Players move their own markers 20 in a clockwise direction according to the guidelines stated below. It should also be noted that on any given turn, any number of place markers 20 may rest upon a single, same board space.

Except as noted, a responding player normally moves his or her marker 20 one board space forward for each matching prediction of his or her response card 40 made by other players. Additionally, except as noted, all other players move their markers 20 three spaces forward if they correctly match the exposed response card 40 of a responding player.

Two exceptions to the above rules for moving are noted. The first exception occurs when any player's place marker 20 is situated atop a board space that matches the color/indicia of his marker 20 at the start of a move forward. When this occurs, a player doubles the number of move spaces forward earned on that turn. A second exception occurs when any player lands a place marker 20 on a "Move Ahead" board space 15*a* or a "Move Back" board space 15*b*. Players landing on these board spaces having instructions, then comply with the direction inscribed on the space—to either move their markers 20 forward or backward the number of spaces instructed.

To help illustrate these rules for moving, assume the following example of a preferred embodiment of the game in which there are five players. After having both sides of a scenario card 30 read aloud, a responding player privately decides on a response of "B" and indicates such with a choice "B" response card 41*b*. Two other players correctly predict the responding player's answer and indicate such with their choice "B" response cards 41*b*. The remaining two players incorrectly predict the responding player's choice and indicate such with their choice "C" response cards 41*c*. Thus, upon revealing all players' selections, a responding player would normally move her marker 20 two spaces forward—one for each correct prediction made by other players. The two players correctly predicting a responding player's choice would each normally move their markers 20 three spaces forward. The two players making incorrect predictions would not move any spaces on this turn of the game. However, to further illustrate the exceptions noted above, assume that a responding player has a "Work Wacky" place marker 20*f*, and on the turn described she is situated atop a "Work Wacky" board space 13*f*. Since there is a match between her marker 20*f* and her board space 13*f*, she is allowed to double her move forward, as noted above. Thus, rather than two spaces forward, she may move four spaces (two times two) forward. Further assume that one of the players correctly predicting a responding player's choice has an "Around Home" place marker 20*b*, and he is also situated atop an "Around Home" board space 13*b* at the start of the move. Therefore, his marker 20*b* matches his board space 13*b*, he is also allowed to double his allotted move of three spaces forward, giving him a move forward of six spaces. Further assume that upon making his move forward of six spaces, he lands upon a "Move Back" board space 15*b* which instructs him to move back one space. So, he immediately moves his marker 20*b* back one space, as required, with a net result for him of moving five spaces forward on this turn.

Play continues in the manner described above, with players taking turns reading and responding to scenario cards 30 and moving their markers 20 along the board spaces until one or more players reaches ending board space 12.

The first player to place his or her place marker 20 on ending board space 12 is declared the winner of the game, and the game is completed. Players do not need to earn the exact number of moves forward to land on space 12—as long they have at least enough spaces forward to reach it. Further, if two or more players reach space 12 on the same turn, a tie is declared.

As will be apparent to those skilled in the art in light of the preceding disclosure, many modifications, alterations, and substitutions are possible in both the apparatus and the method of this invention without departing from the spirit or scope thereof. To highlight this point, a preferred embodiment of the game would include written game instructions that specifically encourage players to try variations of the standard method of play described above. Several such variations are suggested. For example, players might vary the prescribed number of move spaces allotted for each correct match or prediction of a response in order to make the game either shorter or longer. Alternatively, players might agree to respond to a scenario card 30 in a manner that is the most opposite from what they would truly do. Another variation might require all responding players to justify a response by relating a real-life example of an instance when they reacted in a manner consistent with the response chosen. These and other variations of a preferred embodiment serve to make the game more interesting when it is repeatedly played by adding new elements of amusement.

Additionally, new sets of scenario cards 30 might be provided to add interest and novelty to the game. Thus, based on a format similar to the current game and keeping the same card set headings 31, further editions of a scenario game might focus situations on specific themes such as political correctness, aging, changes in a new millennium, current events, travel, foreign cultures, partners, and so on.

Further, although a traditional board game format is described as a preferred embodiment, other adaptations are certainly possible. For example, an electronic personal computer version of this scenario game apparatus and method is a potential variation. Such an embodiment could support single or multiple-player games using methods and apparatus suited to players on a single computer or across multiple computers interfaced by telecommunications lines.

Another possible adaptation of the current invention is a television game show format. Using similar methods and apparatus that have proven successful on other popular game shows, participants could include famous people as game players, and game apparatus could be tailored to a format easily viewed via television.

Accordingly, the disclosed scenario game apparatus and method is not intended to be limited to the particular apparatus and methods described herein except as may be required by the lawful scope of the following claims.

What is claimed is:

1. A game playing apparatus comprising:

(a) a game board including a plurality of colored spaces bearing indicia representing a plurality of situational themes, said colored spaces forming a path or course;

(b) a plurality of board markers;

(c) a plurality of cards of a first type being of like size and shape, each having a front and a reverse side, said reverse sides each being of a like appearance, and said front sides each bearing unique response indicia for corresponding to one of a predetermined set of response indicators; and (d) a plurality of cards of a second type being of like size and shape, each having a front and a reverse side, said front sides each describing a unique situation, and said reverse sides bearing a legend presenting unique responses to said unique situation, wherein said legend of unique responses includes each of the predetermined set of response indicators.

2. The apparatus according to claim 1 wherein said plurality of board markers bear indicia matching each type of said plurality of situational themes on said game board.

3. The apparatus according to claim 1 wherein an object of the game is to learn more about personalities of a group of two or more persons.

4. The apparatus according to claim 1 wherein the apparatus additionally comprises a container for holding said plurality of cards of a second type.

5. The apparatus according to claim 4 wherein said container for holding a plurality of cards comprises:

(a) a base unit comprising a bottom and four side walls to form a rectangular box having an opening on the top;

(b) an inner form filling divider within said base unit being the same height depth and width of said base unit so that the base unit is divided into separate compartments of approximately equal size;

(c) a top cover also having a top and four side walls to form a rectangular box having an opening on the bottom, wherein said top cover is slightly larger then said base unit so that the top cover fits over said base unit when in a closed configuration and fits under said base unit when in an open configuration.

6. Apparatus according to claim 5 wherein said top cover bears indicia representing a plurality of situational themes consistent with indicia appearing on said board spaces and said place markers.

7. The apparatus according to claim 1 wherein there are from two to six situational themes and at least one of the situational themes is selected from the group consisting of:

(a) Among Friends (b) Around Home (c) Favorite Things (d) Getting By (e) Strange Stuff (f) Work Wacky.

8. The apparatus according to claim 1 wherein the apparatus comprises at least one or any combination of:

(a) a written guideline enumerating and equating Arabic numerals one through thirty-one with specific criterion applicable to players of the game playing apparatus;

(b) a starting space;

(c) an ending space, such that when reached the game has a winner;

(d) at least one player choice space, such that when reached a player has a choice as to which of a plurality of categories to answer;

(e) at least one move ahead space, that his associated with specific instructions regarding movement forward of said board markers;

(f) at least one move backward space, that is associated with specific instructions regarding movement backward of said board markers.

9. The apparatus according to claim 1 wherein there are four response indicators.

10. The apparatus according to claim 9 wherein the response indicators are selected from letters A through D.

11. The apparatus according to claim 1 wherein said front sides bearing said unique situation and said reverse side bearing said legend presenting unique responses of said plurality of cards of a second type correspond to at least one of the situational themes of said game board.

12. A method of playing a game by a plurality of players, comprising:

(a) selecting a player to be a first responding player of the game;

(b) providing a game board including a plurality of colored spaces bearing indicia representing a plurality of situational themes, said spaces forming a path or course comprising a starting space and an ending space;

(c) providing a set of scenario cards, each having a front and reverse side, said front side describing a unique situation, and said reverse side bearing a legend presenting unique responses to said unique situation;

(d) providing all players a set of response cards, said set of response cards having identical front sides and reverse sides that have response indicia that correspond to each possible response on said legend of unique responses;

(e) providing each player one board place marker;

(f) placing all said place markers on said starting space of said game board;

(g) said first responding player choosing one said scenario card;

(h) transmitting scenario information and possible scenario responses on said scenario card to all the players;

(i) said first responding player privately deciding one of the responses set out on the scenario card by selecting an appropriate response card and placing it front side up, rendering it indistinguishable from all other response cards;

(j) all players secretly indicating each of their best predictions as to said first responding player's response by selecting an appropriate response card and placing it front side up, rendering it indistinguishable from all other response cards;

(k) revealing said responses by turning all said response cards reverse-side up so as to expose the response indicia;

(l) moving said place markers in accordance with matching responses revealed by said response cards;

(m) repeating the above steps for each of the players in turn, whereby each player in turn assumes the role described for said first responding player;

(n) ending play when one or more of the players' said place markers reaches said ending space; and (o) declaring the player that first reaches the ending space the winner.

13. The method of claim 12 wherein the response selected by said responding player is that response that most closely resembles the action that said responding player would actually take in his or her own life.

14. The method of claim 12 wherein the response selected by said responding player is that response that is the most opposite of an action said responding player would actually take in his or her own life.

15. The method of claim 12 wherein said responding player must support each of his or her responses by describing a real life example of an instance where said responding player reacted in a manner consistent with the response chosen.

16. The method of claim 12 wherein there are four response indicators.

17. The method according to claim 16 wherein the response indicators are selected from letters A through D.

18. The method of claim 12 wherein the step of player choosing a scenario card further comprises:

(p) if the board space under said first responding player's marker has an indicia matching a situational theme, said first player selecting a scenario card having the situational theme matching indicia of said board space, otherwise said first responding player selecting any scenario card.

19. The method of claim 12 wherein the moving in step (l) comprises:

(a) a player responding to said scenario card will move a predetermined number of game board space forward for each matching prediction of the other players;

(b) all other players will move a predetermined number of game board spaces forward when matching the response of the responding player to said scenario card.

20. The method of claim 19 wherein the predetermined number of game board spaces forward for the responding playing is from one to four and the predetermined number of game board spaces forward for the player who match the response is from one to six.

21. The method of claim 19 wherein the number of board spaces moved by the players is doubled when said place marker indicia matches the board space indicia.

22. The method of claim 12 wherein the first player is chosen based on a written guideline enumerating and equating Arabic numerals one through thirty-one with specific criterion applicable to players of the game playing apparatus.

23. The method of claim 12 wherein when a player's place marker lands on a board space with instructions to move a predetermined number of spaces, the player will move according to the board space instructions.

24. The method of claim 23 wherein the board space with instructions can be movement forward or backward.

25. The method of claim 12 wherein the player transmitting scenario information and possible scenario response is a reading player.

26. The method of claim 25 wherein the player transmitting scenario card to all the players can change the scenario to make it more amusing or fitting to the responding player.

27. The method of claim 12 adapted for use on an electronic personal computer.

28. The method of claim 12 adopted for use as a television game show format.

29. A game playing apparatus comprising:

(a) a game board including a plurality of colored spaces bearing indicia representing a plurality of situational themes, said colored spaces forming a path or course;

(b) a plurality of board markers;

(c) a plurality of scenario cards being of like size and shape, each having a front and a reverse side, said front sides each describing a unique situation, and said reverse sides bearing a legend presenting unique responses to said unique situation; and (d) a plurality of response cards being of like size and shape, each having a front and a reverse side, said reverse sides each being of a like appearance, and said front sides each bearing unique response indicia for corresponding to one of said unique responses to said unique situation, wherein one player selects one of said plurality of scenario cards and said unique situation and each of said unique responses are read to the one player, the one player secretly indicates his or her selection from said unique responses by placing an appropriate one of said plurality of response cards reverse side up, other players secretly indicate each of their predictions as to said one player's selection by placing an appropriate one of said plurality of response cards reverse side up, all players reveal their selections by turning said response cards front side up, and all players move their place markers in accordance with matching responses revealed.

* * * * *